US011047071B2

(12) United States Patent
Schwemmlein et al.

(10) Patent No.: US 11,047,071 B2
(45) Date of Patent: Jun. 29, 2021

(54) APPARATUS FOR FORMING A LENO SELVAGE

(71) Applicant: Gebrüder Klöcker GmbH, Borken-Weseke (DE)

(72) Inventors: Christoph Schwemmlein, Borken-Weseke (DE); Matthias Klöcker, Borken (DE)

(73) Assignee: GEBRÜDER KLÖCKER GMBH, Borken-Weseke (DE)

( * ) Notice: Subject to any disclaimer, the term of this patent is extended or adjusted under 35 U.S.C. 154(b) by 34 days.

(21) Appl. No.: 16/721,023

(22) Filed: Dec. 19, 2019

(65) Prior Publication Data

US 2020/0199792 A1 Jun. 25, 2020

(30) Foreign Application Priority Data

Dec. 21, 2018 (DE) ..... 202018107373.7

(51) Int. Cl.
*D03C 7/02* (2006.01)
*D03C 9/02* (2006.01)
*D03C 7/00* (2006.01)

(52) U.S. Cl.
CPC ..... *D03C 7/00* (2013.01); *D03C 7/02* (2013.01); *D03C 9/02* (2013.01)

(58) Field of Classification Search
CPC ..... D03C 7/00; D03C 7/02; D03C 9/02
See application file for complete search history.

(56) References Cited

U.S. PATENT DOCUMENTS 776,300 A * 11/1904 Cowan ..... D03C 7/00 139/51
3,015,346 A * 1/1962 Kaufmann ..... D03C 7/02 139/52
3,353,569 A * 11/1967 Koch ..... D03C 9/0633 139/51
3,990,481 A * 11/1976 Graf ..... D03C 7/02 139/52
4,967,802 A * 11/1990 Klocker ..... D03C 7/02 139/51
4,987,928 A * 1/1991 Gaisser ..... D03C 7/00 139/52
5,040,571 A * 8/1991 Klocker ..... D03C 9/02 139/52
6,102,080 A * 8/2000 Hockemeyer ..... D03C 7/02 139/52

(Continued)

FOREIGN PATENT DOCUMENTS

CN 206680653 U 11/2017
DE 3818680 C1 10/1989

(Continued)

*Primary Examiner* — Robert H Muromoto, Jr
(74) *Attorney, Agent, or Firm* — Dinsmore & Shohl LLP

(57) ABSTRACT

A device for forming a leno selvedge has two lifter seats and a metallic approximately U-shaped half heddle with two legs, which are connected by a web, wherein each lifting heddle has a lifting heddle foot having an opening extending in the longitudinal direction of the heddle, wherein the lifting heddle foot at least on one side of the slot at least one magnet, with which the one leg of the half heddle cooperates, wherein the opening extends over the entire height of the heddle foot continuously.

10 Claims, 2 Drawing Sheets

(56) References Cited

U.S. PATENT DOCUMENTS

| | | | | |
|---|---|---|---|---|
| 6,116,291 | A * | 9/2000 | Hockemeyer | D03C 7/02 139/51 |
| 6,955,191 | B2 * | 10/2005 | Hockemeyer | D03C 7/02 139/51 |
| 7,185,679 | B2 * | 3/2007 | Schwemmlein | D03C 7/02 139/54 |
| 7,984,732 | B2 * | 7/2011 | Sugiyama | D03C 9/06 139/55.1 |
| 8,944,116 | B2 * | 2/2015 | Jaruse, Sr. | D03C 7/02 139/52 |
| 2005/0284532 | A1 * | 12/2005 | Schwemmlein | D03C 7/02 139/55.1 |
| 2019/0376211 | A1 * | 12/2019 | Schwemmlein | D03C 3/24 |
| 2020/0199792 | A1 * | 6/2020 | Schwemmlein | D03C 9/02 |

FOREIGN PATENT DOCUMENTS

| | | | |
|---|---|---|---|
| EP | 0393460 | B1 | 6/1994 |
| EP | 0566163 | B1 | 5/1996 |
| WO | 2007068388 | A1 | 6/2007 |

* cited by examiner

APPARATUS FOR FORMING A LENO SELVAGE

CROSS-REFERENCE TO RELATED APPLICATION

This application claims priority of German Utility Model DE 20 2018 107 373.7 filed Dec. 21, 2018, the entire content of which is incorporated herein by reference.

FIELD OF THE INVENTION

The invention relates to an apparatus for forming a leno selvage comprising two lifting heddles and one metallic half-heddle of approximately a U shape and having two limbs that are connected by a web, wherein each lifting heddle has a lifting heddle foot that has an opening that extends in the longitudinal direction of the lifting heddle, wherein the lifting heddle foot has at least one magnet at at least one side of the opening, said at least one magnet cooperating with the limb of the half-heddle.

BACKGROUND OF THE INVENTION

Apparatus for forming a leno selvage, wherein the control of the half-heddle takes place magnetically by the lifting heddles, are known from the prior art. In detail, the production of a half-leno selvage takes place using an apparatus of two lifting heddles and one half-heddle in that the half-heddle has an eye for receiving a standing thread in the region of the web, with a leno thread running between the limb of the half-heddle and the lifting heddle. Since now the leno thread migrates from the one side of the half-heddle to the other side of the half-heddle on every change of shed and correspondingly from the one lifting heddle to the other lifting heddle, a half-leno selvage is provided, as already stated.

It is essential for the production of a proper weave that it is always ensured that the leno thread actually migrates from the one side of the half-heddle to the other side of the half-heddle on each shed change. This is ensured in that the magnet in the lifting heddle foot ensures during the entrainment movement of the half-heddle through the one lifting heddle that the half-heddle does not float, i.e. that it is always ensured that the half-heddle is properly transferred from the one lifting heddle to the other lifting heddle on a shed change. The control of the half heddles by the lifting heddles takes place, as stated, by the cooperation of the magnets of the lifting heddles with the metallic limbs of the half-heddle. Reference is made to DE 3818680 C1 in this respect.

It has now been shown over the course of time that the kinetic energy that acts on the half-heddle is so large, in particular in looms having high weft counts of substantially more than 400 wefts a minute, that limb of the half-heddle admittedly comes into contact with the magnet of the lifting heddle, but nevertheless runs through downwardly, that is, past the magnet. This in particular takes place when the half-heddle produced from plastic has become worn. The following must be stated in this respect. Every half-heddle has two limbs that are connected to one another by a web at the upper end. An eye for guiding the standing thread is located above the web. The eye is seated on a saddle of the lifting heddle by the web. The saddle of the lifting heddle has a spacing from the at least one magnet at the lower end of the half-heddle that approximately corresponds to the length of the limb of the half-heddle, measured from the web. The web of the half-heddle cuts into the lifting heddle in the region of the saddle over the course of time. The consequence of this is that the spacing between the saddle on which the web of the half-heddle lies and the magnet becomes smaller; this means that the limb of the half-heddle passes the at least one magnet of the lifting heddle. A proper weave then no longer results in any case. Fabrics with weave defects are rather produced. A leno weave apparatus has now become known in this connection in which a stopper is worked into the lifting heddle below the magnet and ensures that the half-heddle is held at the latest in the region of the stopper, wherein the stopper has a spacing from the magnet that is suitable such that the half-heddle is held by the at least one magnet of the lifting heddle and thus the control of the transfer of the half-heddle from the one lifting heddle to the other lifting heddle by the magnet actually takes place properly on every shed change (EP 0 393 460 B1 (EP 0 566 163 B1).

These apparatus for forming a leno selvage that have been described above have proven themselves thousands of times in daily use. Over the course of time, however, the number of wefts of the loom has risen continuously so that customary weft numbers are currently at more than 800 wefts per minute, and indeed irrespective of whether it is an air-jet loom or a rapier loom. This means that the kinetic energy that acts on the leno weave apparatus and here in particular on the half heddles is huge, which in particular also relates to the wear of the lifting heddles in the region of the saddle. There is furthermore a high dust load in the operation of the looms due to the high speeds.

The lifting heddle has a slit for the limb of the half-heddle in the region of the lifting heddle foot. The at least one magnet is arranged in at least one side of the slit in the lifting heddle foot. The previously mentioned stopper is optionally below the magnet and/or the slit is closed in the lower region.

It has been found in this connection that dust collects in the slit of the lifting heddle foot and builds up in the course of operation. This means that what will happen is that due to the dust accumulation the half-heddle starts to "float" in the slit of the lifting heddle foot of the lifting heddle because the half-heddle no longer lies on the saddle. This means that on a shed change the half-heddle is no longer seated on the saddle of the lifting heddle and as a result it is not ensured on a shed opening that the leno thread can move from the one side of the half-heddle to the other side of the half-heddle.

It is known in this connection from WO 2007 068 388 A1 to take measures in the region of the lifting heddle foot and of the half-heddle foot that are intended to prevent dust from collecting in the lifting heddle foot. Provision is made in detail here to form both the lifting heddle foot and the half-heddle foot in wedge shape so that the dust can move out to the side. It is, however, disadvantageous that, if dust nevertheless collects at the foot of the lifting heddle, the total apparatus for forming the leno selvage has to be dismantled for cleaning since a lateral access would be required for cleaning at the machine for which purpose, however, no space is present since the leno weave apparatus hang in a tightly packed manner.

SUMMARY OF THE INVENTION

The underlying object of the invention now comprises preventing, or at least reducing, dust build-up in the opening of the lifting heddle foot and optionally to permit an easier cleaning.

It is suggested in accordance with the invention to achieve the object that the opening extends over the total height of the lifting heddle foot. This means that the opening is continuous over the length of the lifting heddle foot, that is, it is also open at both ends. This applies with the exception of the space the heddle carrier rail takes up at the lifting heddle foot. However, it is at least possible to clean the continuous opening in the lifting heddle foot from above using suitable means.

Provision is made in accordance with an advantageous embodiment that the opening can be formed as a slit. This means that the opening for forming the slit is open over the height of the lifting heddle foot, that is, laterally. The possibility is hereby opened up, for example, of cleaning the slit with a slim blade or a similar article in that the blade is led through the opening or slit, optionally up to the heddle carrier rail, to then clean the space in parallel with the heddle carrier rail by a suitable slim tool. This means that there is the possibility of cleaning the lifting heddle in the region of its foot without having to dismantle the leno weave apparatus.

This embodiment of the lifting heddle foot has proved to be an effective means to ensure over a long time that fabrics free of weave defects can be produced with comparatively little effort with looms having small and medium weft numbers.

It has already been explained at another passage that fast-running looms run with 800 wefts and more per minute. There is always the risk here that, as has already been explained at another passage, the half-heddle slips past the at least one magnet under certain conditions and that to this extent no proper weave can be ensured.

To now achieve the simple keeping clean of the slit or opening of the lifting heddle foot and to achieve in parallel that the limb of the half-heddle is held, despite the high kinetic energy, by the at least one magnet in the opening or in the slit of the lifting heddle foot, the limb of the half-heddle in accordance with a further feature of the invention has a stopper for contacting the lifting heddle foot. This means that the stopper ensures at high weft numbers that the metallic limb of the half-heddle always moves into the region of the magnet of the lifting heddle foot and that it is ensured that the limb of the half-heddle remains in contact with the respective magnet of the lifting heddle during the upward and downward movement of the lifting heddles.

Further advantageous features and embodiments of the invention result from the dependent claims.

Provision is thus in particular made that the stopper is arranged at the limb of the half-heddle such that the projecting end of the limb of the metallic half-heddle, the lower end in the installed state, projects up to and into the effective region of the at least one magnet in the lifting heddle foot. This means that the stopper is arranged at the limb of the half-heddle such that the control of the half-heddle by the lifting heddles is ensured by the respective at least one magnet of the lifting heddle.

A particular feature of the invention is characterized in that the lifting heddle foot for forming a contact for the stopper is set out laterally. Provision is furthermore made that the limb of the half-heddle for forming a half-heddle foot is likewise set out laterally. This means that the ends of both the lifting heddles and the limbs of the half heddles are adapted to one another with respect to size. Provision is furthermore also advantageously made to this extent that the half-heddle foot has the stopper. To in particular increase the security with fast-running looms that the half-heddle is magnetically controlled or guided by the respective lifting heddle, provision is made that a respective magnet is provided at both sides of the slit or of the opening in the lifting heddle foot, consequently the two magnets are disposed opposite one another. This means that the half-heddle foot that, as already stated, is advantageously set out laterally, magnetically cooperates with the at least one magnet, but advantageously with two magnets in the lifting heddle foot.

Provision is made with respect to the design of the lifting heddles in detail that the lifting heddle has two limbs, with the one limb of the lifting heddle having a guide groove for the one limb, the lower limb in the installed state, of the half-heddle.

The lifting heddle has a saddle for contact with the web of the half-heddle in the transition region of the limbs of the lifting heddle. This means that the saddle acts as a contact surface for the half-heddle and of the web of the half-heddle here on entrainment by the lifting heddle.

BRIEF DESCRIPTION OF THE DRAWINGS

The invention will be described in more detail below by way of example with reference to the drawings.

DETAILED DESCRIPTION OF THE INVENTION

Figure 1:
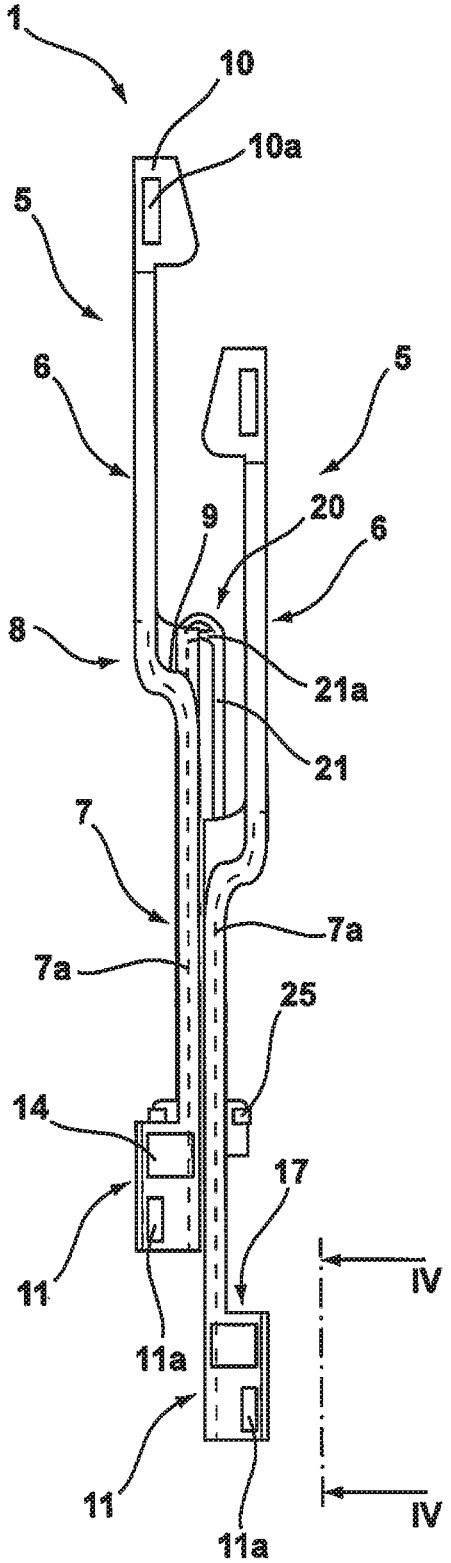
FIG. 1 shows the apparatus for forming a leno selvage in its totality.
Figure 2:
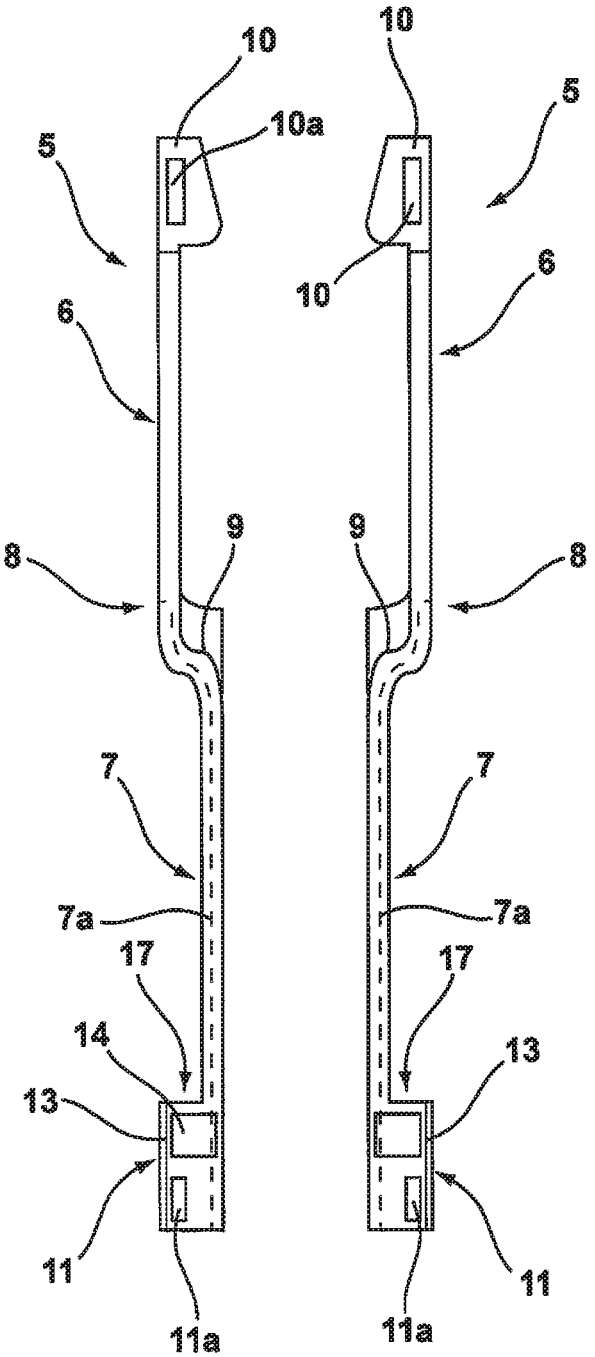
FIG. 2 shows the lifting heddle in a view.

The apparatus for forming a leno selvage (leno weave apparatus) has the reference numeral 1. The leno weave apparatus comprises the two lifting heddles 5 and the half-heddle marked by 20. Each lifting heddle 5 has a first limb 6 and a second limb 7 that are connected to one another approximately centrally (arrow 8) in the region of the saddle 9. A holder 10 is provided in the first upper limb 6 and has an opening 10*a* that serves the connection to, for example, a heddle carrier rail at the loom. The second lower limb 7 has the lifting heddle foot 11 that likewise has an opening 11*a* for equally receiving a heddle carrier rail.

Figure 3:
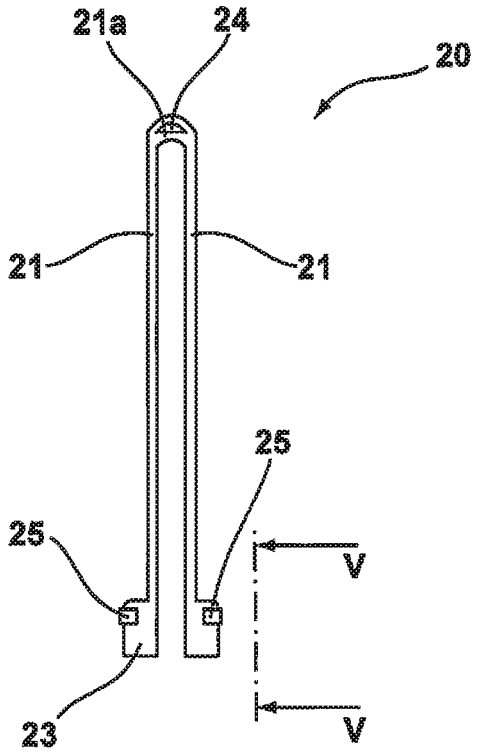
FIG. 3 shows the half-heddle in a view.
Figure 4:
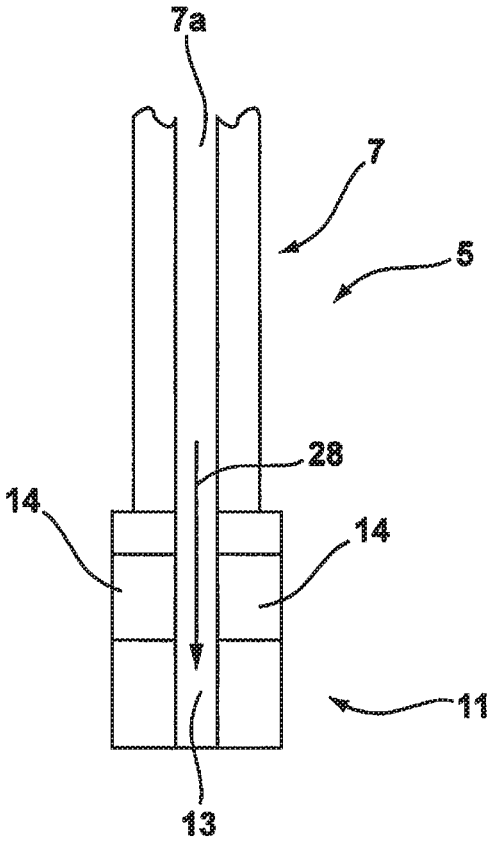
FIG. 4 shows a side view of the lifting heddle as a section in accordance with the line IV-IV of FIG. 1.

The further configuration of the second lower limb 7 is now relevant that has, starting at the center region (arrow 8) a guide groove 7*a* in the region of the saddle 9 for guiding the limbs 21 of the half-heddle 20. The lower limb 7 is provided with the lifting heddle foot 11 at the lower end. The lifting heddle foot 11 has a slit 13 that extends from the upper end to the lower end through the lifting heddle foot 11. The opening 11*a* has been omitted for better clarity. A respective magnet 14 that cooperates with the half-heddle foot 23 of the half-heddle 20 in accordance with FIG. 3 is provided at both sides of the slit. The magnets 14 are directly opposite one another. The slit 13 in the region of the lifting heddle foot 11 forms the prolongation of the guide groove 7*a* in the second lower limb 7 of the lifting heddle 5. It is essential in the embodiment of the lifting heddle foot 11 that the slit 13 as a prolongation of the guide groove 7*a* is continuous to, for example, remove dust building up in the slit 13 from above, and optionally also from the side using a blade (arrow 28), with it having to be mentioned that the leno weave apparatus here does not have to be deinstalled from the loom.

Figure 5:
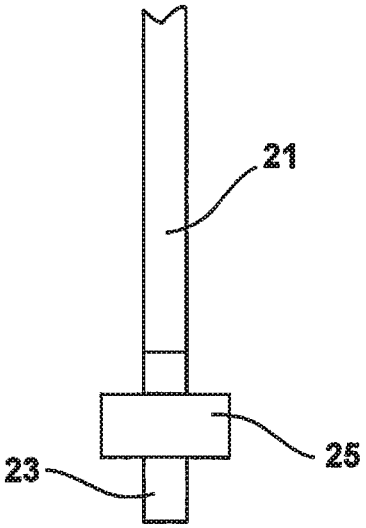
FIG. 5 shows a view in accordance with the line V-V of FIG. 3.

The design of the half-heddle 20 results from a view in FIG. 3 and FIG. 5.

As already explained at another passage, the half-heddle 20 is formed in approximately a U shape in a plan view, with the limbs 21 of the half-heddle being connected by the web 21*a* in the upper region. The eye 24 for the standing thread (not shown) is located above the web 21*a*. The half-heddle 20 lies on the saddle 9 of the lifting heddle 5 by this web, and indeed whenever the lifting heddle 5 is in the upward movement. The leno thread (not shown) is in this case located between the other, oppositely disposed lifting heddle and the corresponding limb of the half-heddle. In this state, the half-heddle 20 is held by the magnets 14 in the lifting heddle foot 11 of the upwardly moving lifting heddle. To now prevent the half-heddle foot 23 of the half-heddle from slipping through the slit 13 in the lifting heddle foot 11 at high weft speeds and with a worn saddle, the half-heddle foot 23 has a stopper 25 that is held by the abutment 17 of the lifting heddle foot 11. The abutment 17 is formed by an upper edge of the lifting heddle foot 11 that is horizontal in the installed state. Provision is made here that the stopper is arranged at the limb of the half-heddle such that the projecting end of the limb 21 of the half-heddle 20, the lower end in the installed state, projects up to and into the effective region of the at least one magnet 14, advantageously of the two mutually opposite magnets, into the lifting heddle foot. It is thus ensured when the stopper 25 lies on the abutment 17 of the lifting heddle foot that the half-heddle foot 23 is in contact with the magnet or magnets 14.

REFERENCE NUMERALS

1 leno weave apparatus
5 lifting heddle
6 first upper limb
7 second lower limb
7*a* guide groove
8 arrow
9 saddle
10 holder
10*a* opening for the heddle carrier rail
11 lifting heddle foot
11*a* opening for the heddle carrier rail
13 slit
14 magnet
17 abutment
20 half-heddle
21 limb
21*a* web
23 half-heddle foot
24 eye
25 stopper
28 arrow

The invention claimed is:

1. An apparatus for forming a leno selvage, comprising: two lifting heddles; and one metallic half-heddle of approximately a U shape and having two limbs that are connected by a web, wherein each lifting heddle has a lifting heddle foot that has an opening that extends in the longitudinal direction of the lifting heddle, and wherein the lifting heddle foot has at least one magnet at at least one side of the slit, said at least one magnet cooperating with the one limb of the half-heddle, wherein said opening extends continuously over the total height of the lifting heddle foot.

2. An apparatus in accordance with claim 1, wherein said opening is configured as a slit.

3. An apparatus in accordance with claim 1, wherein the limb of the half-heddle has a stopper for contacting the lifting heddle foot.

4. An apparatus in accordance with claim 3, wherein the stopper is arranged at the limb of the half-heddle such that the lower end of the limb of the half-heddle that projects over the stopper projects up to and into the effective region of the at least one magnet in the lifting heddle foot.

5. An apparatus in accordance with claim 1, wherein the lifting heddle foot is set out laterally to form an abutment for the stopper.

6. An apparatus in accordance with claim 1, wherein the limb of the half-heddle is set out laterally to form a half-heddle foot.

7. An apparatus in accordance with claim 6, wherein the half-heddle foot has the stopper.

8. An apparatus in accordance with claim 1, wherein the half-heddle foot cooperates with the at least one magnet in the lifting heddle foot.

9. An apparatus in accordance with claim 1, wherein the lifting heddle has two limbs, with the one limb of the lifting heddle having a guide groove for the one limb of the half-heddle.

10. An apparatus in accordance with claim 9, wherein the lifting heddle has a saddle for contact with the web of the half-heddle in the transition region of the limbs of the lifting heddle.

* * * * *